US008857649B2

(12) United States Patent
Buchholz

(10) Patent No.: US 8,857,649 B2
(45) Date of Patent: Oct. 14, 2014

(54) LID FOR MIXING CUPS OF PAINT GUNS

(75) Inventor: Bjoern Buchholz, Lübeck (DE)

(73) Assignee: G-Mate AG, Lübeck (DE)

( * ) Notice: Subject to any disclaimer, the term of this patent is extended or adjusted under 35 U.S.C. 154(b) by 528 days.

(21) Appl. No.: 12/680,293

(22) PCT Filed: Sep. 12, 2008

(86) PCT No.: PCT/EP2008/007501

§ 371 (c)(1),
(2), (4) Date: Mar. 26, 2010

(87) PCT Pub. No.: WO2009/046806

PCT Pub. Date: Apr. 16, 2009

(65) Prior Publication Data

US 2010/0301049 A1 Dec. 2, 2010

(30) Foreign Application Priority Data

Oct. 2, 2007 (DE) ..... 10 2007 048 440

(51) Int. Cl.
*B65D 51/16* (2006.01)
*B05B 7/24* (2006.01)

(52) U.S. Cl.
CPC ..... *B05B 7/2408* (2013.01); *B05B 7/2478* (2013.01)
USPC ..... 220/374; 220/367.1

(58) Field of Classification Search
USPC ..... 220/369, 368, 734, DIG. 5, 203.03, 374, 220/373, 367.1; 55/441; 215/17, 18, 307, 215/11.5
See application file for complete search history.

(56) References Cited

U.S. PATENT DOCUMENTS

| | | | | |
|---|---|---|---|---|
| 1,367,164 | A * | 2/1921 | Miller | 55/441 |
| 3,385,467 | A * | 5/1968 | Lindenberg | 220/374 |
| 3,592,349 | A * | 7/1971 | Baugh | 215/307 |
| 4,307,820 | A * | 12/1981 | Binoche | 220/374 |
| 5,307,994 | A | 5/1994 | Hieronymus | |
| 5,558,244 | A * | 9/1996 | Akaike et al. | 220/374 |
| 5,649,859 | A * | 7/1997 | Shiga | 454/275 |
| 5,692,637 | A * | 12/1997 | Hodge | 220/366.1 |
| 6,820,824 | B1 | 11/2004 | Joseph et al. | |
| 2007/0158349 | A1 | 7/2007 | Schmon et al. | |

FOREIGN PATENT DOCUMENTS

| | | |
|---|---|---|
| DE | 6851 | 3/1954 |
| DE | 73432 | 5/1970 |
| DE | 8702559 | 9/1987 |
| FR | 2468412 | 5/1981 |

OTHER PUBLICATIONS

International Preliminary Report on Patentability dated Jun. 1, 2010 from PCT Application No. PCT/EP2008/007501, 6 pages.
International Search Report and Written Opinion with translation dated Dec. 4, 2008 from PCT Application No. PCT/EP2008/007501, 13 pages.

* cited by examiner

*Primary Examiner* — Jeffrey Allen
(74) *Attorney, Agent, or Firm* — Smartpat PLC; Axel Nix

(57) ABSTRACT

The invention relates to a lid for a closeable mixing container for a paint gun. The lid is provided with a ventilation opening. The ventilation opening is embodied as a labyrinth seal with three cylinders (11, 12, 14), inserted into each other and allowing air to flow.

15 Claims, 2 Drawing Sheets

LID FOR MIXING CUPS OF PAINT GUNS

Figure 1:
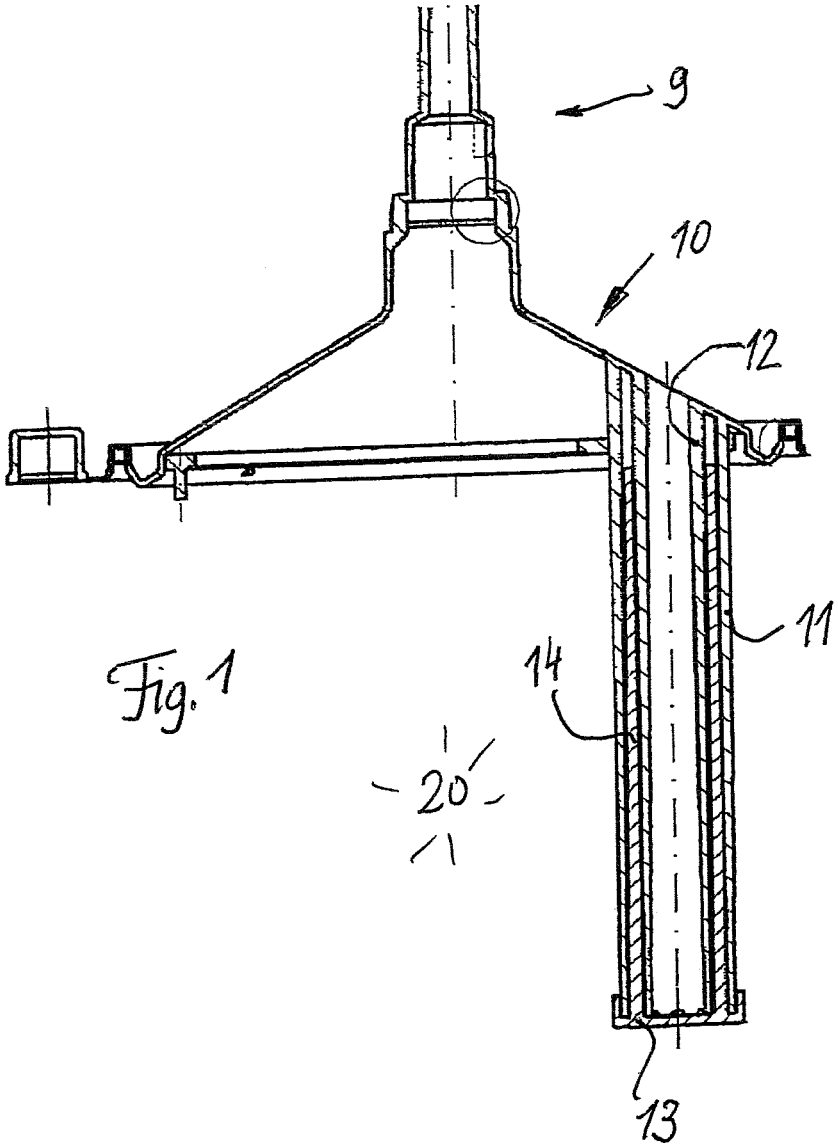

The invention relates to a lid for a closable mixing container for a paint gun, with said lid being provided with a ventilation opening.

A lid, embodied as a single use lid for a closable mixing container for a paint gun, is known (DE 298 25 119 U1). It is placed upon the open mixing container, which has an air hole in its bottom and is provided with a single use insert fitting into the container. The single use lid is pressed into the open end of the single use insert and its central opening is connected to a connecting tube via a bayonet joint.

Another lid for a closable mixing container for a paint gun is known (DE 10 2004 007 733 A1), comprising a connection part to place a flow cup or an adapter onto a paint gun, with the container comprising a ventilation opening that can be closed by a valve.

Until the present, it has been common to expensively clean and/or rinse a paint gun and its cup after each use with the help of solvents (chlorinated hydrocarbons). Accordingly, many million liters of contaminated solvents develop (cleaning solvents). Due to the fact that the paint cup represents the largest surface coated with paint, approximately 90% of the solvent cleaning expense relates to the cup.

There is a so-called bag system. Here, a cup with a very thin wall (similar to a bag) is placed inside a reusable cup. Subsequently a lid is screwed onto said system and then connected upside-down to the gun. During painting a vacuum develops in the "bag" and said bag contracts. This system has two decisive disadvantages. Firstly, an additional mixing cup is required to mix the different paint components together. This results in additional costs and 2 cups must be discarded and/or recycled. Secondly, the spray pattern of the paint gun changes by the vacuum developing in the "bag". This means the more the "bag" contracts the less paint exits the gun.

Furthermore, a mixing cup system is practiced, in which a special paint mixing cup serves as the basis, in which the paint components are mixed. Said paint mixing cup is provided with a lid, turned upside-down, and connected to the paint gun. During painting a vacuum develops in the cup. Said vacuum prevents that the paint flows homogenously to the gun and therefore a manual valve is arranged at the bottom of the cup. Said valve must be opened by the operator (when he/she intends to paint) or closed (when the cup is again placed on its bottom). This is frequently forgotten, so that either paint flows out of the cup or the paint gun begins to stutter. The production costs of the use of this system are very high.

Here, the present invention shall offer a solution and fulfill the following criteria:

The production of the necessary parts must be cost-effective.

It may not require a manual valve.

It must be useable with existing mixing cup systems.

It must not be dependent on a vacuum changing the spray pattern.

This is attained in the present invention according to the claim, namely by the lid for a closable mixing container for a paint gun, with said lid being provided with a ventilation opening characterized in that the ventilation opening is embodied as a labyrinth seal having three cylinders inserted into each other and allowing air to flow.

In preferred embodiments, grooves or channels are formed at least at one of the adjacent jacket surfaces of the cylinders inserted into each others and these grooves or channels are particularly aligned in the axial direction of the cylinders.

In detail: The lid is simply snapped onto existing mixing cup systems. Said lid has a ventilation system, which is very simple in its production, but it provides great benefits in daily use. The painter no longer needs to think about closed or opened valves. After the mixing cup has been provided with the lid, it is also turned upside-down and placed upon the paint gun. Via a special ventilation shaft, now the atmospheric pressure extends into the cup. Here, the special feature is the fact that no paint can leak from the ventilation channel during the "flipping process". For this purpose, a novel channel geometry was invented, which essentially operates like a labyrinth seal.

Cylindrical labyrinth seals in ventilation opening are known per se, however, not provided in the context with mixing container lids for paint guns. For example, labyrinth seals are known at a ventilation slot of a ventilator for transmissions, protected from splashing water and explosions, (DD 73 432 A). Furthermore, there is a gas tank closure (DD 6851 A), which is mounted via a lateral part to the gas tank filler neck and allows that environmental air can enter the tank via a labyrinth seal.

In the following, the invention is explained using the drawings as an example.

FIG. 1 of the drawing shows a cross-section through a lid for a mixing cup of paint guns.

Figure 2:
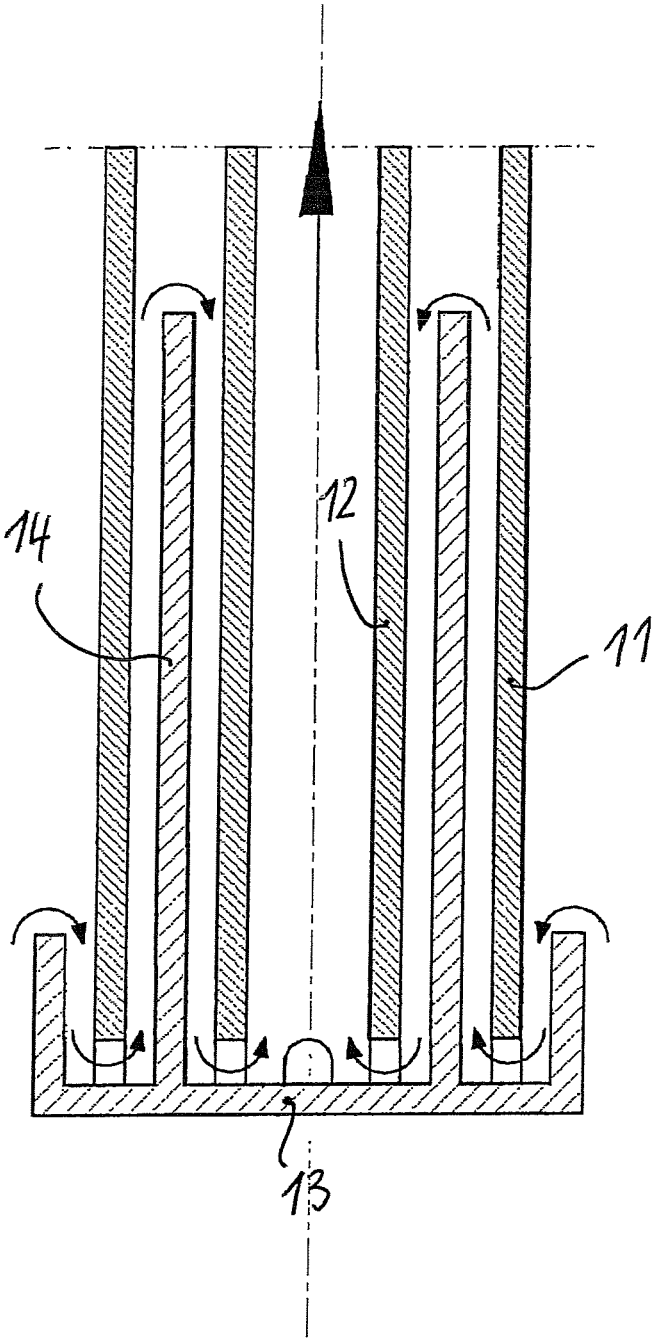

FIG. 2 shows details of the labyrinth seal

The essentially conical lid is marked 10. It represents a rotationally symmetrical part. Parts are discernible in the edge region, which are placed upon the mixing cup, not shown. 9 marks the part that can be connected to the paint gun.

In the present invention, a dual cylinder arrangement is shown at the lid 10, extending into the interior space of the mixing cup. An exterior cylinder 11 is provided, embodied in one piece with the lid. A smaller cylinder 12 is provided inside this larger cylinder 11, also embodied in one piece with the lid 10. The interior cylinder 12 is embodied open towards the top.

A snapping part 13 is arranged at the bottom end of the two cylinders 11 and 12, comprising a cylindrical part 14 which projects upwards. Said part 14 falls short of the axial length of the cylinders 11 and 12. Its wall thickness has been sized such, that it can be inserted with little play into the space between the cylinders 11 and 12. The cylinder part 14 is embodied with a lid part 13, closing the interior of the cylinder 12 towards the bottom, but not sealing it completely. Air could enter via the interior cylinder 12 at the bottom end of said cylinder 12 into the space between the cylinders 11 and 12, i.e. at the location of the cylinder 14. From the bottom upwards, in the viewing direction of the figure, air can now pass the cylinder 14, and exit again downwards, and due to the fact that the lid 13 is embodied such that again at the bottom end air can enter the interior space 20 of the mixing cup, not shown, i.e. forming an air bridge from the exterior of the mixing cup and/or lid 10 to the interior space 20 of the mixing cup. This air bridge is easily possible, if the individual dimensions are sized sufficiently small. Paint located in the interior space 20 cannot penetrate this path to the outside. On the one side, because during operation a respective vacuum is present and, on the other side, because the viscosity of the liquid prevents passing. At the most, a liquid could enter for a certain short distance into the space between the exterior cylinder 11 and the exterior space of the cylinder 14, which however is of lesser importance.

The flow ratios are best discernible from FIG. 2, which here represents a schematic illustration but not a depiction of the actual ratios.

Grooves or channels may be embodied at least at one of the adjacent jacket surfaces of the combined cylinders and said grooves or channels can be aligned in the axial direction of the cylinders, in particular.

The invention claimed is:

1. A lid for a closeable mixing container for a paint gun, the lid comprising:

an inner side configured to face an interior of the mixing container;

a ventilation opening; and a labyrinth seal comprising a free end spaced apart from the inner side and configured to extend into the interior of the mixing container, and three cylinders arranged into each other including an innermost cylinder having a proximal end mechanically connected to the inner side and surrounding the ventilation opening, an intermediate cylinder having a proximal end spaced apart from the inner side, and an outermost cylinder having a proximal end mechanically connected to the inner side and surrounding the proximal end of the intermediate cylinder, wherein a distal end of the intermediate cylinder at the free end of the labyrinth seal is provided with a lid part closing the interior of the innermost cylinder, but spaced apart from a distal end of the innermost cylinder so that a gap allowing air to flow is defined between the distal end of the innermost cylinder and the lid part, and wherein an air path is defined via the labyrinth seal between the ventilation opening communicating with an exterior of the mixing container and a second opening communicating with the interior of the mixing container at or adjacent to a distal end of the outermost cylinder at the free end of the labyrinth seal, and wherein the air path is further defined between the walls of the cylinders so as to allow air to flow but prevent paint to penetrate outside of the mixing container via the air path.

2. A lid according to claim 1, wherein the three cylinders arranged into each other comprise adjacent jacket surfaces and wherein at least one of the adjacent jacket surfaces comprises grooves or channels.

3. A lid according to claim 2, wherein the grooves or channels are aligned in the axial direction of the cylinders.

4. A lid according to claim 1, wherein the lid supports the entirety of the labyrinth seal.

5. A lid according to claim 1, wherein one of the three cylinders of the labyrinth seal has an axial length that is shorter than an axial length of the other two cylinders.

6. A lid according to claim 1, wherein, during operation of the paint gun, the labyrinth seal defines an air bridge between an interior of the mixing container and an exterior of the mixing container.

7. A lid according to claim 1, wherein, during operation of the paint gun, the labyrinth seal is configured to support a vacuum.

8. A lid according to claim 1, wherein the lid is configured to snap fit to the mixing container.

9. A lid according to claim 1, wherein the labyrinth seal prevents leakage of paint from the mixing container when the mixing container is coupled to the paint gun and turned upside-down.

10. A lid for a closeable mixing container for a paint gun, the lid comprising:

an inner side configured to face an interior of the mixing container;

a ventilation opening; and a labyrinth seal comprising:

a free end spaced apart from the inner side and configured to extend into the interior of the mixing container;

a plurality of upper cylinders inserted into each other, the upper cylinders comprising a proximal end mechanically connected to the mixing container lid and a free end configured to extend into an interior of the mixing container;

at least one lower cylinder spaced apart from the mixing container lid and having an axial length shorter than an axial length of the plurality of upper cylinders, the at least one lower cylinder inserted between the plurality of upper cylinders; and an air path defined between the interior of the mixing container and an exterior of the mixing container via the labyrinth seal, the air path further defined between cylinder walls allowing air to flow but preventing paint to penetrate outside of the mixing container via the air path, wherein the at least one lower cylinder of the labyrinth seal comprises a lid having a base;

a wall of the at least one lower cylinder is interleaved between respective walls of the plurality of upper cylinders; and a gap allowing air to flow is defined between the base of the lid and the free ends of the plurality of upper cylinders.

11. A lid according to claim 10, wherein the plurality of upper cylinders and the at least one lower cylinder comprise adjacent jacket surfaces and wherein at least one of the adjacent jacket surfaces comprises grooves or channels.

12. A lid according to claim 11, wherein the grooves or channels are aligned in the axial direction of the cylinders.

13. A lid according to claim 10, wherein the lid supports the entirety of the labyrinth seal.

14. A lid according to claim 10, wherein the lid is configured to snap to the mixing container.

15. A lid according to claim 10, wherein the labyrinth seal prevents leakage of paint from the mixing container when the mixing container is coupled to the paint gun and turned upside-down.

* * * * *